US008750079B2

(12) United States Patent
Lagorgette

(10) Patent No.: US 8,750,079 B2
(45) Date of Patent: Jun. 10, 2014

(54) DISPLAY DEVICE WITH A COMBINATION OF DISPLAY MEMBERS

(71) Applicant: ETA SA Manufacture Horlogere Suisse, Grenchen (CH)

(72) Inventor: Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 13/705,798

(22) Filed: Dec. 5, 2012

(65) Prior Publication Data

US 2013/0148483 A1 Jun. 13, 2013

(30) Foreign Application Priority Data

Dec. 7, 2011 (EP) ..... 11192298

(51) Int. Cl.
*G04B 19/02* (2006.01)
*G04B 19/04* (2006.01)

(52) U.S. Cl.
USPC ..... 368/220; 368/223; 368/228

(58) Field of Classification Search
USPC ..... 368/76, 80, 220, 221, 223, 228
See application file for complete search history.

(56) References Cited

U.S. PATENT DOCUMENTS 3,695,035 A 10/1972 Cleusix
3,969,888 A * 7/1976 Veuilleumier et al. ..... 368/35
3,978,654 A * 9/1976 Koike et al. ..... 368/80
4,097,755 A * 6/1978 Kitai et al. ..... 310/114
4,241,438 A * 12/1980 Kern ..... 368/185
4,684,263 A 8/1987 Etienne
4,985,877 A * 1/1991 Namisato ..... 368/76

FOREIGN PATENT DOCUMENTS

DE 410 706 3/1925
EP 0 217 251 A1 4/1987
JP 59-114481 7/1984
JP 2005-331325 12/2005

OTHER PUBLICATIONS

European Search Report issued Mar. 9, 2012 in corresponding European Application No. 11 19 2298 filed on Dec. 7, 2011 (with an English Translation).

* cited by examiner

*Primary Examiner* — Vit W Miska
(74) *Attorney, Agent, or Firm* — Oblon, Spivak, McClelland, Maier & Neustadt, L.L.P.

(57) ABSTRACT

Timepiece display device (100) comprising a first display member (1) cooperating with first drive means (10) via a first transmission means (11), and a second display member (2), cooperating with a second drive means (20) via a second transmission means (21).

First contactless coupling means (12) are carried by said first display member (1) or by said first transmission means (11), second contactless coupling means (22) are carried by said second display member (2), or by said second transmission means (21), said first coupling means (12) cooperate with said second coupling means (22) in a complementary, contactless, attraction coupling in order, when said coupling means are located in immediate proximity to each other, to unite the motion of said first display member (1) and said second display member (2).

Said first coupling means (12) and said second coupling means (22) are magnetic or electrostatic.

9 Claims, 1 Drawing Sheet

DISPLAY DEVICE WITH A COMBINATION OF DISPLAY MEMBERS

This application claims priority from European Patent Application No. 11192298.5 filed Dec. 7, 2011, the entire disclosure of which is incorporated herein by reference.

FIELD OF THE INVENTION

The invention concerns a timepiece display device with a combination of display members comprising at least a first display member, arranged to cooperate with a first drive or control means via first transmission means, and at least a second display member, arranged to cooperate with a second drive or control means via second transmission means.

The invention further concerns a timepiece comprising a control means arranged for controlling a first display member via a first drive or control means and for controlling a second display member via a second drive or control means, and including a display device of this type.

The invention concerns the field of scientific instruments and more particularly the field of mechanical and/or electronic horology.

BACKGROUND OF THE INVENTION

In a watch with a quartz movement, when the rotor of the stepping motor makes one step, a display member, generally a hand, makes a pivoting movement through a given angular step of a few degrees. At the end of this pivoting movement, the hand stops, and the stopping is generally accompanied by an oscillation, which may be visually unpleasant for the user, particularly when the pivoting movement of the hand is slow, such as during display of a particular function, for example a compass function, with a single phase motor. It is known to reduce or remove this oscillation by inserting an elastic friction washer in the gear train, to create continuous friction which completely damps the oscillation, but at the cost of a subsequent excessive use of energy, and thus a loss in efficiency.

Another method of removing the oscillation defect is for the hand to perform a rapid movement, so that it then no longer has time to oscillate at the end of each step. However, this rapid movement cannot be achieved with a single phase motor, of the type conventionally used to drive the display member when implementing a particular function, other than the time display.

The general problem which arises is improving the coupling between a plurality of display members, particular two display members, with the lowest possible loss of energy, both during the coupling and the separation of the display members.

It is known to form a mechanical coupling between display members, particularly by friction, and more particularly using one or several springs. FR Patent No. 2 256 459 in the name of TIMEX CO. thus discloses a time zone mechanism with a coupling and a spring stop. GB Patent No. 731 689 in the name of HAMM discloses the synchronous driving of a second set of hands for setting an alarm, via the main set of hands, after the change from the alarm time, using springs.

EP Patent No. 1 916 574 in the name of VAUCHER S A discloses an indicator hand for displaying several pieces of information, comprising a first index portion corresponding, for example, to a conventional time display, hinged to a second index portion, which is provided with a radial or conical toothing and intended to be driven by the pivoting movement about a second axis of rotation perpendicular to the first axis of rotation about which the first index portion pivots.

Various types of magnetic coupling have been displayed for particular applications, and always between a motor means and a single display member. CH Patent No. 528 765 dated 1972 in the name of OMEGA S A discloses a mechanism for changing the indication of the hour hand by the stem, without any additional push-buttons. This mechanism includes a bottom motion-work hand controlling the hour hand via a motion-work pinion. The arbour of this pinion carries a loosely mounted top wheel, which is coaxial to and magnetically positioned relative to a bottom wheel and is actuated by the movement. The bottom wheel is controlled by the stem to rotate the hour hand without affecting the indication of the other hands. A flat spring including a ramp tends to push the top wheel towards the bottom wheel, via a bearing plate which rests on the top wheel via a metal foil with star-shaped resilient arms. The position of the stem controls the pivoting of a lever, one arm of which cooperates with the ramp of the flat spring, to allow, according to the position of the stem, the top and bottom wheels to move further apart or closer together. The friction applied by the metal foil is greater than the magnetic coupling force between the top and bottom wheels. The bearing plate includes posts which pass through and trap the top wheel and can cooperate with passages comprised in the bottom wheel to drive said wheel by mechanical coupling in the set-hands position. The springs introduce resistant stresses into the mechanism which adversely affect its efficiency.

JP Patent Application No. 58 097 682 in the name of SEIKOSHA discloses the driving of hands by magnetic coupling with the wheels, in a configuration which means that the movement is very thick.

DE Patent No. 254 7657 in the name of JUNG discloses a conventional timepiece mechanism driving hands hidden behind a plate, the end of each hand is magnetised and attracts a ball through the plate. Only the ball can be seen by the user. U.S. Pat. No. 3,701,252 in the name of TAKESHI OKAMOTO discloses a similar system.

EP Patent Application No. 0 308 243 in the name of SEIKO discloses a magnetic coupling on a display element which causes indices to appear in the form of balls enclosed in a chamber pressed against an aperture, or which starts the movement of a decoration mounted on a spring upon the passage of the poles of a magnetic element, rotor or hand.

However, although solutions are found for driving or displaying a display member, the prior art does not propose any indexing between two display members of different sizes.

SUMMARY OF THE INVENTION

The invention proposes to overcome the problems and limitations of the prior art when display members are coupled to each other:

- the oscillation of at least one of the display members during alignment with another display member;
- the high power consumption required to align two display members and/or to release one of the two display members from the other;

so as to achieve a motion of the display member, particularly a hand, that is a continuous fluid movement.

The invention therefore concerns a timepiece display device with a combination of display members comprising at least a first display member, arranged to cooperate via a first transmission means with a first drive or control means, and at least a second display member, arranged to cooperate via a second transmission means with a second drive or control means, characterized in that, on the one hand, a first, contactless, coupling means is carried by said first display member or by said first transmission means, and on the other hand, a second, complementary, contactless, coupling means is carried by said second display member or by said second transmission means, and in that said first coupling means is arranged to cooperate with said second complementary coupling means in a complementary contactless coupling via attraction in order, when said first and second coupling means are located in immediate proximity to each other, in certain relative positions only of said first display member relative to said second display member, to unite the movement of said first display member and of said second display member, the cooperation between said first coupling means and said second complementary coupling means creating an additional force or torque between said first display member and the second display member so as to damp the oscillation thereof.

According to a feature of the invention, said first coupling means and said second complementary coupling means are magnetic in nature.

According to another feature of the invention, said first coupling means and said second complementary coupling means are electrostatic in nature.

According to a feature of the invention, said first coupling means and said second complementary coupling means are respectively arranged on said first display member and on said second display member.

According to another feature of the invention, said first coupling means and said second complementary coupling means are respectively arranged on said first transmission means and on said second transmission means.

According to a feature of the invention, said first transmission means or said second transmission means can be uncoupled by a command initiated by a control means, so as to allow whichever one of the first display member or second display member is uncoupled from its drive or control means to be driven by the one which is coupled to its drive or control means.

According to a feature of the invention, said first transmission means and said second transmission means can be uncoupled by a command initiated by a control means, so as to allow said first display member and/or said second display member to be driven by a third drive or control means or by a magnetic field or by an electric field.

According to a feature of the invention, in order to align the displays of said first display member and said second display member, a control means is arranged to shift in time a command for a first action on said first display member by said first drive or control means and a command for a second action on said second display member by said second drive or control means, so as to damp any oscillation of the display member which was operated last, by the effect of mutual attraction between said first coupling means and said second complementary coupling means when said display member is aligned in proximity to the display member which was operated first.

The invention further concerns a timepiece comprising a control means arranged for controlling a first display member by a first drive or control means and for controlling a second display member by a second drive or control means, and comprising a display device of this type, characterized in that said display device is controlled by said control means.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
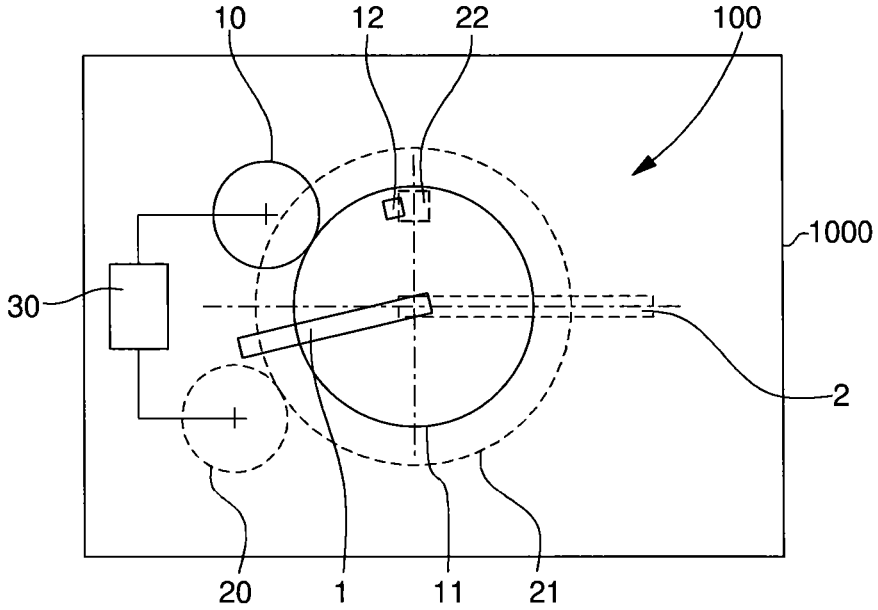
FIG. 1 shows a schematic view of a timepiece including a display device with a combination of display members according to the invention, and a means of controlling said device.

The invention concerns the field of scientific instruments and more particularly the field of mechanical and/or electronic horology.

The invention will be more particularly described for a preferred, but non-limiting application to a watch comprising display functions in addition to the time display, and using all or part of the time display means for these additional displays. The invention is equally applicable to a watch with a mechanical movement and to a watch with a quartz movement, or to a watch with mixed mechanical-electronic technology.

A more particular example will be used with a compass function, in which a conventional hour hand and minute hand are aligned to form a diametral compass hand.

The invention proposes to overcome the problems and limitations of the prior art when display members are coupled to each other:

- the oscillation of at least one of the display members during alignment with another display member, "alignment" meaning here a movement to reach a particular indexed position;
- the high power consumption required to align two display members and/or to release one of the two display members from the other when they are separated, either in normal operation or to ensure another function;

The invention therefore concerns a timepiece display device 100 with a combination of display members. This device 100 includes at least one display member 1, arranged to cooperate via a first transmission means 11 with a first drive or control means 10, and at least a second display member 2, arranged to cooperate via a second transmission means 21 with a second drive or control means 20.

According to the invention, on the one hand a first, contactless, coupling means 12 is carried by first display member 1 or by the first transmission means 11, and on the other hand, a second, complementary, contactless, coupling means 22 is carried by the second display member 2 or by the second transmission means 21.

The first coupling means 12 is arranged to cooperate in a complementary, contactless coupling by attraction with the second, complementary, coupling means 22 in order, when said first and second coupling means are located in immediately proximity to each other, only in certain relative positions of the first display member 1 to the second display member 2, to unite the movement of the first display member 1 and the second display member 2.

The cooperation between the first coupling means 12 and the second, complementary, coupling means 22 creates an additional torque or force between the first display member 1 and second display member 2 so as to damp the oscillation and/or vibration of said first display member 1 and/or said second display member 2.

Naturally, the invention may be extended to a greater number of display members than two, for example three concentric watch hands or similar. The example described in detail here of the cooperation between two display members is in no way limiting.

The oscillation of a display member, particularly the hand of a timepiece or watch controlled by an electric motor, is caused, on the one and by the inertia in the rotor of said motor, which oscillates after a driving pulse, and on the other hand, by the play in the gears, since the inertia of the display member or hand and the gear trains causes them to oscillate within the limit of the play of the gear trains.

The insertion of a coupling according to the invention, particularly a magnetic or electrostatic coupling, means that, only in certain positions, an additional torque or force can be momentarily introduced, which is similar to friction in the effect produced, which damps the oscillation.

The damping quality depends upon the adjustment of the coupling, but it is always present. In short, it is only in particular relative positions of the display members or hands that this damping is created.

The fact that the damping is not, therefore, permanent, avoids any adverse effect on the power consumption and efficiency of the motor.

"Uniting" means the fact of forming a coupling between first display member 1 and second display member 2. According to the invention, this coupling includes damping the display member which joins the other in a required indexed position. The damping is obtained precisely owing to implementation of the contactless coupling means.

In a first embodiment of the invention, the first coupling means 12 and second complementary coupling means 22 are magnetic in nature.

In another embodiment of the invention, the first coupling means 12 and second complementary coupling means 22 are electrostatic in nature.

First coupling means 12 and second, complementary, coupling means 22 may be arranged in different ways in the kinematic chain of each of the display members.

In particular, according to a first variant, the first coupling means 12 and second, complementary, coupling means 22 are respectively arranged on first display member 1 and on second display member 2. In another variant, the first coupling means 12 and second, complementary, coupling means 22 are respectively arranged on first transmission means 11 and on second transmission means 21. These variants are not limiting, and first coupling means 12 may also be arranged on first display member 1 and second, complementary, coupling means 22 may be arranged on second transmission means 21, or vice versa, or in another manner.

In a particular embodiment, the first transmission means 11 or second transmission means 21 can be uncoupled by a command initiated by a control means 30, so as to allow whichever one of first display member 1 or second display member 2 is uncoupled from its drive or control means to be driven by the other display member which is coupled to its drive or control means.

In another particular embodiment, the first transmission means 11 and second transmission means 21 can be uncoupled by a command initiated by a control means 30, so as to allow first display member 1 and/or second display member 2 to be driven by a third drive or control means or by a magnetic field or by an electric field. The driving may also be obtained by processing a signal transmitted by a measuring sensor or sensor measuring the state of a physical magnitude, for example a radioactivity sensor, a barometric sensor, lighting or other sensor.

Preferably, the operation of withdrawing from the coupling position is carried out with a pulse directly or indirectly imparted to at least one of the two display members relative to the other. In the case of an electronic timepiece, this pulse may easily result from a current or voltage peak in the drive motor, or suchlike. In the case of a timepiece with a mechanical movement, the pulse may be achieved by a cam or ramp.

It should be noted that, in the case of a watch, this withdrawal operation does not only occur on withdrawal from the coupling position, but also at any time when, due to the normal operation of the movement, first display member 1 and second display member 2 are in the particular indexing position in relation to each other.

In the example of a compass function, where a compass hand is formed by the combination of an hour hand and minute hand in indexed alignment at 180°, the first coupling means 12 and second coupling means 22 move into cooperation each time that these two hands are in a position of alignment, i.e. each time that the compass function is implemented, but also each time that the normal operation of the movement places them in alignment with each other, which occurs twenty four times per day for a dial with a twelve hour display. To avoid making the display member drive means excessively large in order to overcome the attraction torque or force exerted by first coupling means 12 and second complementary coupling means 22 on each other, it is thus advantageous for a pulse to be performed in each of these circumstances.

The first drive or control means 10 and second drive or control means 20 can then operate in a continuous movement. The size thereof must allow them, in normal operation, to overcome the attraction force or torque, while the use of a function uncoupling one of the two display members at the end of the alignment operation allows the attraction force or torque to overcome the force of inertia, to achieve a damped indexing, without any vibration.

Figure 2:
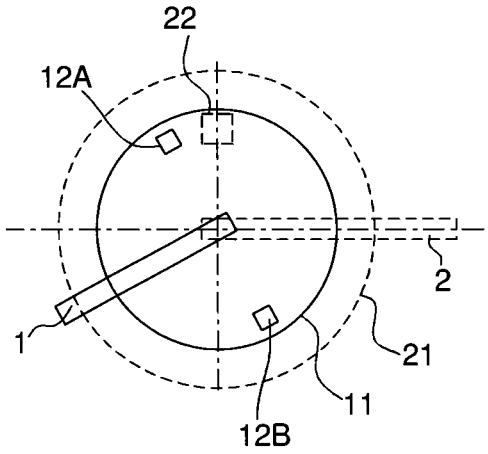
FIG. 2 shows a schematic view of a variant wherein a first wheel, forming part of a first means of transmitting motion to a first display member, formed here by a first hand, carries two sets of first coupling means arranged opposite at 180° relative to the pivot axis thereof, whereas a second wheel, forming part of second means of transmitting motion to a second display member, formed here by a second hand, carries a single set of second coupling means, arranged to cooperate in a complementary coupling with one or other of the two sets of first coupling means of the first wheel.
Figure 3:
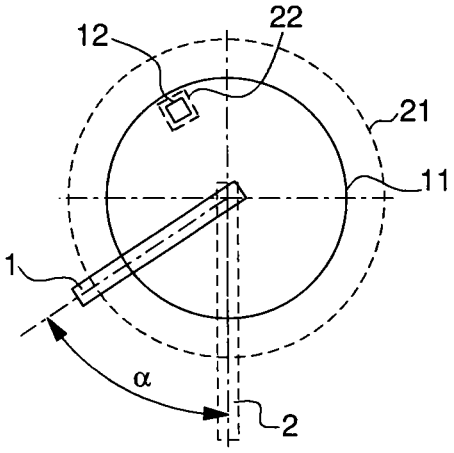
FIG. 3 shows a similar schematic view to FIG. 2 of another variant wherein the first coupling means of the first wheel and the second coupling means of the second wheel are arranged to index, the first display member and second display member in the coupling position with a given angular shift $\alpha$.

The indexing between the display members can be multiplied. Thus FIG. 2 shows a case where a wheel of first transmission means 11 carries first coupling means 12A and other first coupling means 12B, opposite at 180° relative to the pivot axis of said wheel, whereas a wheel of second transmission means 21 only carries one second coupling means 22. This configuration therefore enables display members 1 and 2 to be used in alignment or superposition, depending on the function used, according to the commands given by control means 30 to first drive or control means 10 and to second drive or control means 20. FIG. 3 illustrates a case where first coupling means 12 and second coupling means 22 are arranged to index first display member 1 and second display member 2 with a given angular shift $\alpha$.

Advantageously, in a particular embodiment, in order to align the displays of first display member 1 and second display member 2, a drive means 30 is arranged to shift in time a command for a first action on first display member 1 by first drive or control means 10, and a command for a second action on second display member 2 by second drive or control means 20. This time shift is carried out so as to damp any oscillation of the display member which was last operated, by the effect of mutual attraction between first coupling means 12 and second, complementary, coupling means 22, when said display member which was last operated is aligned in proximity to the display member which was first operated.

To return to a particular example, that of a compass mode display, achieved in particular in a watch with a quartz movement, in particular the "T-Touch"® by TISSOT S. A., the first display member 1 is formed by the hour hand and the second display member 2 is formed by the minute hand. These two hands change function during the change into compass mode, in which they are aligned with each other and then oriented towards magnetic north. It is an object of the invention to rapidly damp the oscillation of the hand at the end of each step in compass mode. Since the duration of operation in compass mode only represents a very small part of the duration of operation of the watch, the solution offered by the invention must not adversely affect power consumption in normal operation. The alignment configuration of the two hands, outside the compass mode, occurs 24 times per day in normal operation for the normal time display. The motors driving the two hands are operated one after the other. When the hour hand moves, the minute hand remains stationary, then when the hour hand has finished its step, it is the minute hand which moves while the hour hand remains stationary. The end of the step of the hand is damped by the coupling, which is preferably magnetic or electrostatic, between the hour wheel and the minute wheel. When the minute hand finishes its step, it is retained by the hour hand which has remained stationary, and vice versa when the hour hand moves. The magnetic coupling can be achieved by a magnet on the minute wheel and a magnetic pin on the hour wheel, or directly on both hands. When the minute hand finishes its step, the magnetic coupling with the hour wheel immediately damps the oscillation of said hand. A mechanical coupling can be achieved in the same manner with spring elements on the wheels or mechanical elements, but this latter solution is less advantageous than the magnetic and electrostatic solutions in terms of power consumption. The solution implemented by the invention is carried out on the mechanical components of the timepiece and does not impact the drive motor. The very low power consumption generated by this solution only occurs in compass mode and 24 times per day on a few rotor pulses.

In the preferred version where the display members or hands are driven by an electric motor, the coupling torque resulting from the cooperation between the first coupling means 12 and second coupling means 22 is sized so that it remains lower than the positioning torque delivered by the drive motors of one of the display members, with respect to the pivot arbour of said display member. In the preferred case where one of the display members (the static member) is immobilised before the other (moving member), as in the example of the compass above where one of the two motors is always stopped while the other one is activated, the static display member is therefore not driven by the motion of the moving display member.

Preferably, control means 30 includes software which blocks the member of the static display member by reinjecting current into the coil.

It is clear that the moving display member may require more current to be able to take its step, but the impact on power consumption remains small, since, in the preferred case of watch hands, the alignment of the hands only occurs 24 times per day.

If it is desired to couple two display members or hands, and to drive them in a coupled manner, one of the two motors must be uncoupled, or the positioning torque exerted by said motor, with respect to the arbour of the display member, must be made lower than the coupling torque, by control means 30, which, in order to withdraw from coupling mode, may then inject current into the coil of the driven motor, in order to block the corresponding display member, and the torque thereof, with respect to the arbour of the display member, therefore becomes greater than the coupling torque again.

The invention further concerns a timepiece 1000 including a control means 30 arranged to control a first display member 1 by a first drive or control means 10 and to control a second display member 2 by a second drive or control means 20 and including a display device 100 of this type controlled by said control means 30.

What is claimed is:

1. A timepiece display device with a combination of display members comprising at least a first display member, arranged to cooperate via a first transmission means with a first drive or control means, and at least a second display member, arranged to cooperate via a second transmission means with a second drive or control means, wherein, on the one hand, a first contactless coupling means is carried by said first display member or said first transmission means, and on the other hand a second, complementary, contactless coupling means is carried by said second display member or by said second transmission means, and wherein said first coupling means is arranged to cooperate with said second complementary coupling means in a complementary, contactless, attraction coupling in order, when said first and second coupling means are located in immediate proximity to each other in only certain relative positions of said first display member and said second display member, to unite the motion of said first display member and said second display member, the cooperation between said first coupling means and said second complementary coupling means creating an additional torque or force between said first display member and said second display member to damp the oscillation thereof.

2. The display device according to claim 1, wherein said first coupling means and said second, complementary, coupling means are magnetic in nature.

3. The display device according to claim 1, wherein said first coupling means and said second, complementary, coupling means are electrostatic in nature.

4. The display device according to claim 1, wherein said first coupling means and said second, complementary, coupling means are respectively arranged on said first display member and on said second display member.

5. The display device according to claim 1, wherein said first coupling means and said second, complementary, coupling means are respectively arranged on said first transmission means and on said second transmission means.

6. The display device according to claim 1, wherein said first transmission means or said second transmission means can be uncoupled by a command initiated by a control means, so as to allow whichever one of the first display member or second display member is uncoupled from the drive or control means thereof to be driven by the other display member which is coupled to the drive or control means thereof.

7. The display device according to claim 1, wherein said first transmission means and said second transmission means can be uncoupled by a command initiated by a control means, so as to allow first display member and/or second display member to be driven by a third drive or control means or by a magnetic field or by an electric field.

8. The display device according to claim 1, wherein in order to align the displays of said first display member and said second display member, a control means is arranged to shift in time a command for a first action on said first display member by said first drive or control means and a command for a second action on said second display member by said second drive or control means, so as to damp any oscillation of the display member which was operated last, by the effect of mutual attraction between said first coupling means and said second complementary coupling means when said display member which was operated last is aligned in proximity to the display member which was operated first.

9. A timepiece comprising a control means arranged for controlling a first display member by a first drive or control means and for controlling a second display member by a second drive or control means, and comprising a display device according to claim 1, wherein said display device is controlled by said control means.

* * * * *